US005561245A

United States Patent [19]

Georgi et al.

[11] Patent Number: 5,561,245

[45] Date of Patent: Oct. 1, 1996

[54] METHOD FOR DETERMINING FLOW REGIME IN MULTIPHASE FLUID FLOW IN A WELLBORE

[75] Inventors: Daniel T. Georgi; Shanhong Song; Jian C. Zhang, all of Houston, Tex.

[73] Assignee: Western Atlas International, Inc., Houston, Tex.

[21] Appl. No.: 424,155

[22] Filed: Apr. 17, 1995

[51] Int. Cl.[6] ..... E21B 47/00

[52] U.S. Cl. ..... 73/152.02; 73/61.44; 73/861.04; 73/152.18; 324/324

[58] Field of Search ..... 73/19.04, 19.05, 73/61.44, 61.46, 61.47, 861.04, 155; 324/323, 324, 325

[56] References Cited

U.S. PATENT DOCUMENTS

| | | | |
|---|---|---|---|
| 3,279,249 | 10/1966 | Tocanne | 73/155 |
| 3,844,170 | 10/1974 | Critten | 73/861.06 |
| 4,441,362 | 4/1984 | Carlson | 73/155 |
| 4,461,165 | 7/1984 | Kesson | 73/19.05 |
| 4,583,409 | 4/1986 | Lannuzel et al. | 73/861.25 |
| 4,604,902 | 8/1986 | Sabin et al. | 73/861.04 |
| 4,774,469 | 9/1988 | Sobolev et al. | 324/323 |
| 4,786,857 | 11/1988 | Mohr et al. | 324/58.5 |
| 4,788,852 | 12/1988 | Martin et al. | 73/61.1 |
| 4,856,344 | 8/1989 | Hunt | 73/861.04 |
| 4,884,457 | 12/1989 | Hatton | 73/861.04 |
| 5,029,481 | 7/1991 | Keech | 73/861.06 |
| 5,083,452 | 1/1992 | Hope | 73/61 |
| 5,148,405 | 9/1992 | Georgi et al. | 367/13 |
| 5,218,871 | 6/1993 | Cody et al. | 73/861.04 |
| 5,251,479 | 10/1993 | Siegfried, II et al. | 73/155 |
| 5,353,627 | 10/1994 | Diatschenko et al. | 73/19.03 |
| 5,387,752 | 2/1995 | Den Boer | 73/861.04 |

*Primary Examiner*—Richard Chilcot
*Assistant Examiner*—Paul D. Amrozowicz
*Attorney, Agent, or Firm*—Richard A. Fagin

[57] ABSTRACT

The invention is a method of determining the flow regime of fluid having more than one phase flowing in a conduit. The method includes the step of positioning a sensor in the conduit, the sensor generating measurements capable of discriminating more than one phase in the fluids, generating measurements from the sensor for a period of time, characterizing the measurements with respect to changes in magnitude of the measurements occurring during the period of time, and comparing the characterized measurements to similarly characterized measurements of a similar sensor positioned within flow streams having known flow regimes.

In a preferred embodiment of the invention, the characterization of the measurements includes performing a variability analysis of the measurements.

23 Claims, 10 Drawing Sheets

METHOD FOR DETERMINING FLOW REGIME IN MULTIPHASE FLUID FLOW IN A WELLBORE

BACKGROUND OF THE INVENTION

1. Field of the Invention

The present invention is related to the field of production logging of oil and gas wells. More specifically, the present invention is related to methods of determining the manner of fluid flow, or fluid flow regime, in a wellbore by using measurements made by production logging instruments.

2. Discussion of the Related Art

Wellbores drilled into petroleum reservoirs within earth formations for the purpose of producing oil and gas typically produce the oil and gas from one or more discrete hydraulic zones traversed by the wellbore. When the wellbore is completed the zones are hydraulically connected to the wellbore. The oil and gas can then enter the wellbore, whereupon they can be transported to the earth's surface entirely by energy stored in the reservoir, or by various methods of pumping.

Some of the hydraulic zones within a particular wellbore can traverse a substantial length. In other wellbores a plurality of zones can be simultaneously hydraulically connected to the wellbore. In order for the wellbore operator to maximize the efficiency with which the oil and gas are extracted from the reservoir, it is useful to determine the amount of oil and gas, or other fluids such as water, entering the wellbore from any particular point along the length of any particular zone.

Various instruments have been devised which can be used to determine the amounts of fluids, including oil, gas and water, which enter the wellbore from any particular point within any hydraulic zone. The instruments known in the art for determining the amounts of fluids entering the wellbore are called production logging tools.

Production logging tools are typically lowered into the wellbore at one end of an armored electrical cable. The tools can comprise sensors which are responsive to, among other things, the fractional volume of water filling the wellbore, the density of the fluid within the wellbore and the flow velocity of the fluid filling the wellbore. A record is typically made, with respect to depth within the wellbore, of the measurements made by the various sensors so that calculations can be made of the volumes of fluids entering the wellbore from any depth within the wellbore.

Methods known in the art for calculating the relative volumes of fluids entering the wellbore by using production logging tool measurements generally require the use of laboratory determined models of the responses of the various production logging sensors to a range of volumetric flow rates of the different fluid phases in the wellbore. All of the sensor response models known in the art are based on an assumed "flow regime" of the fluids entering the wellbore. The flow regime is a description of the manner in which any or all of the individual phases of fluids in the wellbore travel along the wellbore, the phases typically being liquid oil, gas and water. A discussion of flow regimes can be found, for example in "A Comprehensive Mechanistic Model for Upward Two-Phase Flow in Wellbores", Ansari et al, Society of Petroleum Engineers, paper no. 20630.

A drawback to the methods known in the art for calculating the relative volumes of fluids entering the wellbore is that the methods known in the art do not account for the fact that the actual flow regime in the wellbore may be different from the particular flow regime assumed in the sensor response model. The calculations of relative volumes can therefore be erroneous.

It is known in the art to determine the flow regime by the use of iterative calculation techniques to fit the actual production logging tool measurements to a particular flow regime and then calculate the fluid volumes after determining the flow regime. Iterative calculation techniques can be difficult and time consuming to perform, and ultimately do not determine the flow regime to a high degree of certainty.

Accordingly, it is an object of the present invention to provide a fast, reliable method of determining the flow regime in a wellbore using the measurements made by production logging tools.

SUMMARY OF THE INVENTION

The present invention is a method of determining the flow regime of fluid in a conduit wherein the fluid has more than one phase. The method includes the step of positioning a sensor in the conduit, the sensor generating measurements capable of discriminating more than one phase in the fluid, generating measurements from the sensor for a period of time, characterizing the measurements with respect to changes in the magnitude of the measurements during the period of time, and then comparing the characterized measurements to similarly characterized measurements of a similar sensor positioned flow streams having known flow regimes.

In a preferred embodiment of the invention, the step of characterizing the measurements includes performing a Fourier transform on the measurements. The output of the Fourier transform can be compared to Fourier transforms of sensor measurements of laboratory model flow regimes in order to determine the flow regime in the wellbore.

In specific embodiment of the invention, the sensor can comprise a production logging tool inserted into a wellbore. The production logging tool can include a capacitance probe, a fluid density device, and a fluid velocity sensor.

DESCRIPTION OF THE PREFERRED EMBODIMENT

The description of the preferred embodiment of the invention is divided into two parts. The first part describes the operation of a production logging tool in a wellbore and the acquisition of sensor data to be processed according to the present invention. The second part describes the processing of sensor data acquired by the production logging tool in order to determine the flow regime in the wellbore.

1. Operation of a production logging tool and data acquisition

Figure 1:
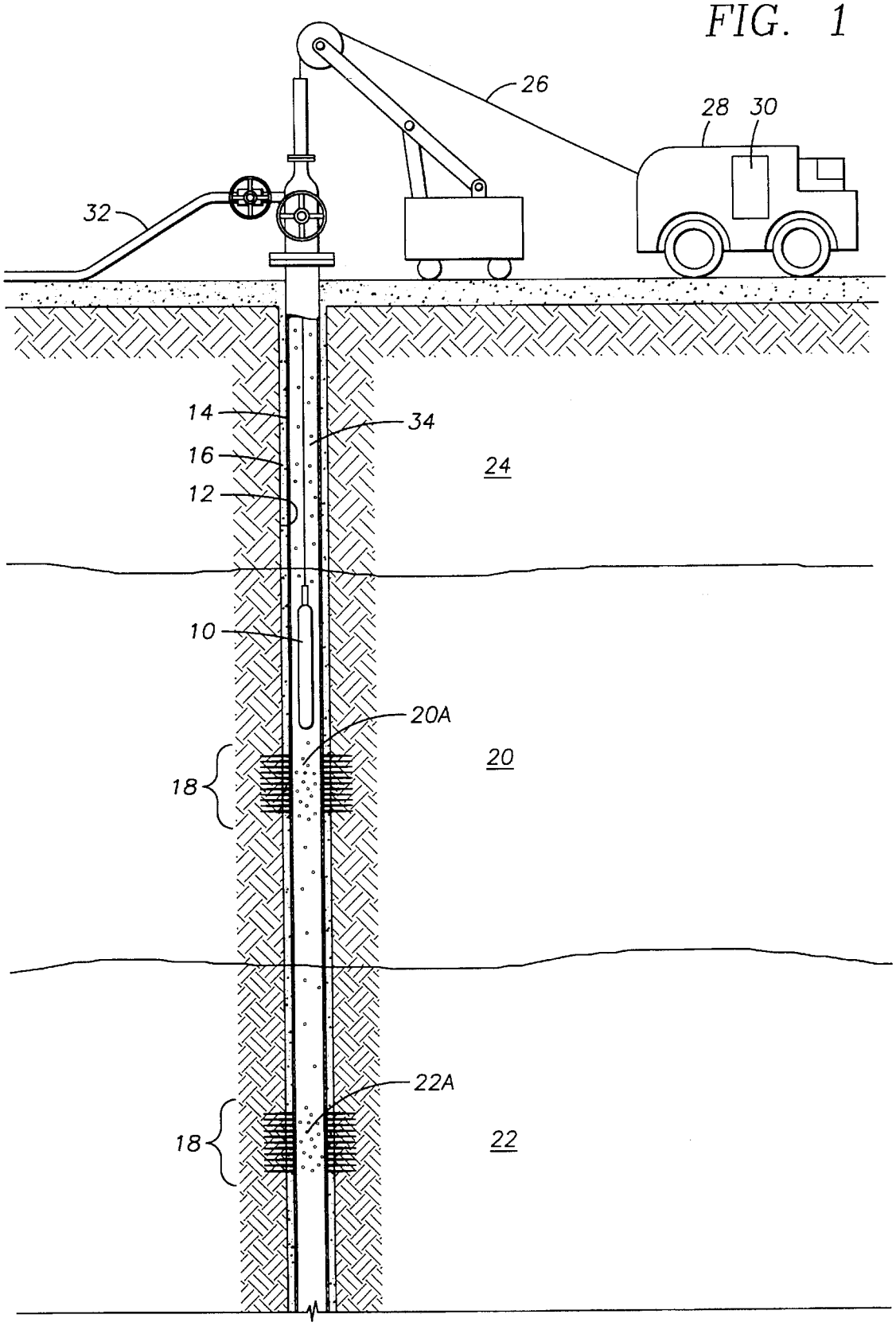
FIG. 1 shows a production logging tool disposed in a wellbore penetrating two zones which discharge fluids into the wellbore.

A production logging tool 10 is shown in FIG. 1 being lowered into a wellbore 12 drilled through an earth formation 24. The tool 10 is connected to one end of an armored electrical cable 26. The cable 26 is extended into the wellbore 12 by means of a winch (not shown separately) forming part of a logging unit 28. The other end of the cable 26 is electrically connected to surface electronics 30 forming part of the logging unit 28. The surface electronics 30 can include a computer (not shown separately) for performing calculations on measurements made by the tool 10, as will be further explained. The tool 10 imparts signals to the cable 26 corresponding to measurements made by various sensors in the tool 10, as will be further explained. The signals imparted to the cable 26 are received and interpreted by the surface electronics 30, wherein the various measurements made by the tool 10 can be derived.

The wellbore 12 is shown as penetrating a first zone 20 and a second zone 22, both of which can form part of the earth formation 24. The wellbore 12 is further shown as being completed by having a steel casing 14 coaxially inserted therein. The casing 14 is hydraulically sealed by pumping cement 16 around the outside of the casing 14 in an annular space existing between the casing 14 and the wellbore 12, as is understood by those skilled in the art. The first zone 20 and the second zone 22 are typically hydraulically connected to the wellbore 12 by making perforations 18 in the casing 14 and cement 16, as is also understood by those skilled in the art.

The first zone 20 may be vertically spaced apart from the second zone 22 by a substantial vertical distance, and therefore can have a substantially different fluid pressure within its pore space than does the second zone 22, the pressure differential being principally caused by the earth's gravity, as is understood by those skilled in the art. The first zone 20 may also be of a different rock composition and may contain different relative volumes of oil, gas and water within its porosity than does the second zone 22. For these reasons and for other reasons known to those skilled in the art the fluid 20A from the first zone 20 may enter the wellbore 12 at different rates and the fluid 20A may have different fractional volumes of oil, gas and water than does the fluid 22A entering from the second zone 22. The manner in which the fluid flows in the wellbore 12, called the "flow regime", can be substantially different adjacent to the second zone 22 than it is adjacent to the first zone 20, and the flow regime at either of these positions in the wellbore 12 may be substantially different than the flow regime of total produced fluid, shown at 34, which travels to the earth's surface. The total produced fluid 34 is eventually conducted to equipment (not shown) at the earth's surface by a flowline 32 connected to the wellbore 12, wherein volumes of each of three phases of fluid, oil gas and water, can be measured.

Figure 2:
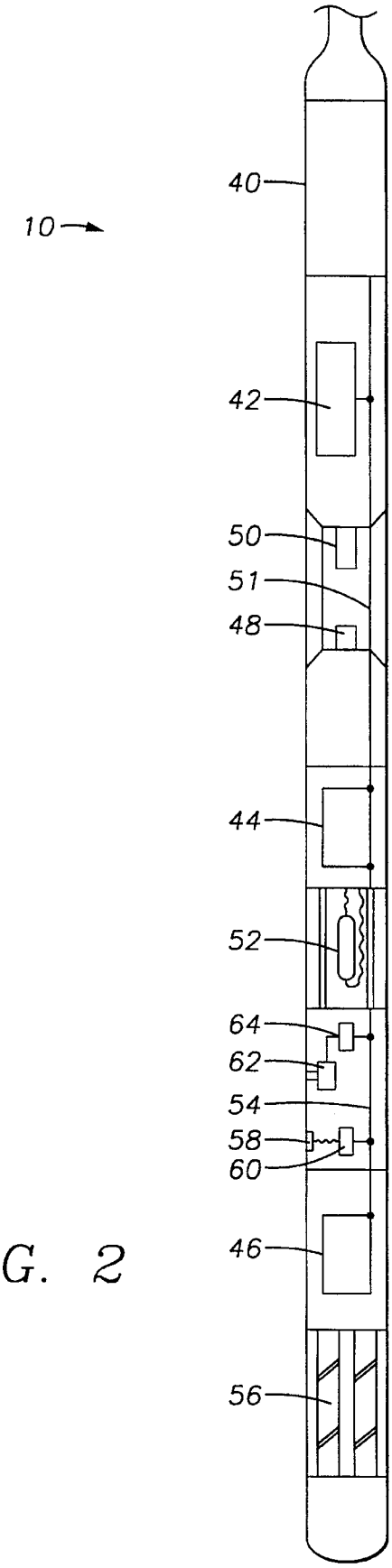
FIG. 2 shows various sensors which can form pan of the production logging tool.

The production logging tool 10 of the present invention can be better understood by referring to FIG. 2. The tool 10, as previously explained, is connected to one end of the cable 26. The tool 10 comprises various sensors which can be positioned at various locations along the tool 10. The sensors can include an impeller type flowmeter, shown generally at 56. The flowmeter's impeller 56 rotates at an angular speed proportional to, among other things, the velocity of fluid moving past the impeller 56. The impeller 56 is connected to a first signal generator 46 which imparts signals to a signal bus 54, the signals corresponding to the rotary speed of the impeller 56.

The sensors also can include a capacitance probe 52. The capacitance probe 52 admits fluid from the wellbore (shown as 12 in FIG. 1) into a chamber (not shown separately) having a predetermined volume. The probe 52 is connected to a second signal generator 44 which generates signals corresponding to the capacitance measured by the probe 52. As is understood by those skilled in the art, the capacitance measured by the probe 52 is indicative of the fractional volume of water disposed within the probe 52 chamber. The capacitance probe 52, therefore, is known in the art as fractional water volume, or a "water holdup", sensor. The second signal generator 44 is also connected to the bus 54, to where the signals from the capacitance probe 52 are transmitted.

The sensors can also comprise a fluid density device 51 which includes a source of gamma rays 48 and a radiation counter 50. As is understood by those skilled in the art, the amount of radiation detected by the counter 50 is indicative of the density of the fluid which is positioned inside the device 51. The counter 50 is connected to a third signal generator 42 which imparts signals to the bus 54 corresponding to the detection of radiation by the counter 51.

The sensors can also include an absolute pressure sensor 62 and a temperature sensor 58, respectively connected to a third 64 and fourth 60 signal generator, which are themselves connected to the bus 54.

The bus 54 can be connected to a telemetry transceiver 40, which imparts encoded signals to the cable 26, the encoded signals corresponding to the signals from each one of the signal generators 46, 44, 42, 64, 60. These signals are decoded and interpreted by the surface electronics (shown in FIG. 1 as 30). In decoding the signals, the surface electronics 30 generates measurements corresponding to, among other things, the density of the fluid, the fractional volume of water in the fluid, the pressure, the temperature and the velocity of the fluid within the wellbore 12 with respect to the depth at which the measurements were made within the wellbore 12. A record is typically made of the sensor measurements with respect to depth within the wellbore 12 by moving the tool 10 along the wellbore 12 and simultaneously recording the sensor measurements generated over a range of depths through which sensor measurements are desired.

The tool 10 as shown in FIG. 2 has the sensors positioned so that they are generally located within only one small portion of the cross-sectional area of the wellbore 12 during a survey. As is understood by those skilled in the art, various instruments (not shown) have been devised for positioning sensors at a plurality of predetermined positions within the cross-sectional area of the wellbore 12 to facilitate determining the relative volumes of different fluids within the wellbore 12 at any depth. The significance of determining the fluid volumes at various positions within the cross-sectional area of the wellbore 12 will be further explained. The tool 10 as shown in FIG. 2 is used to illustrate the different types of sensors which are included in a typical production logging tool.

2. Data processing and determination of the flow regime

Figure 3:
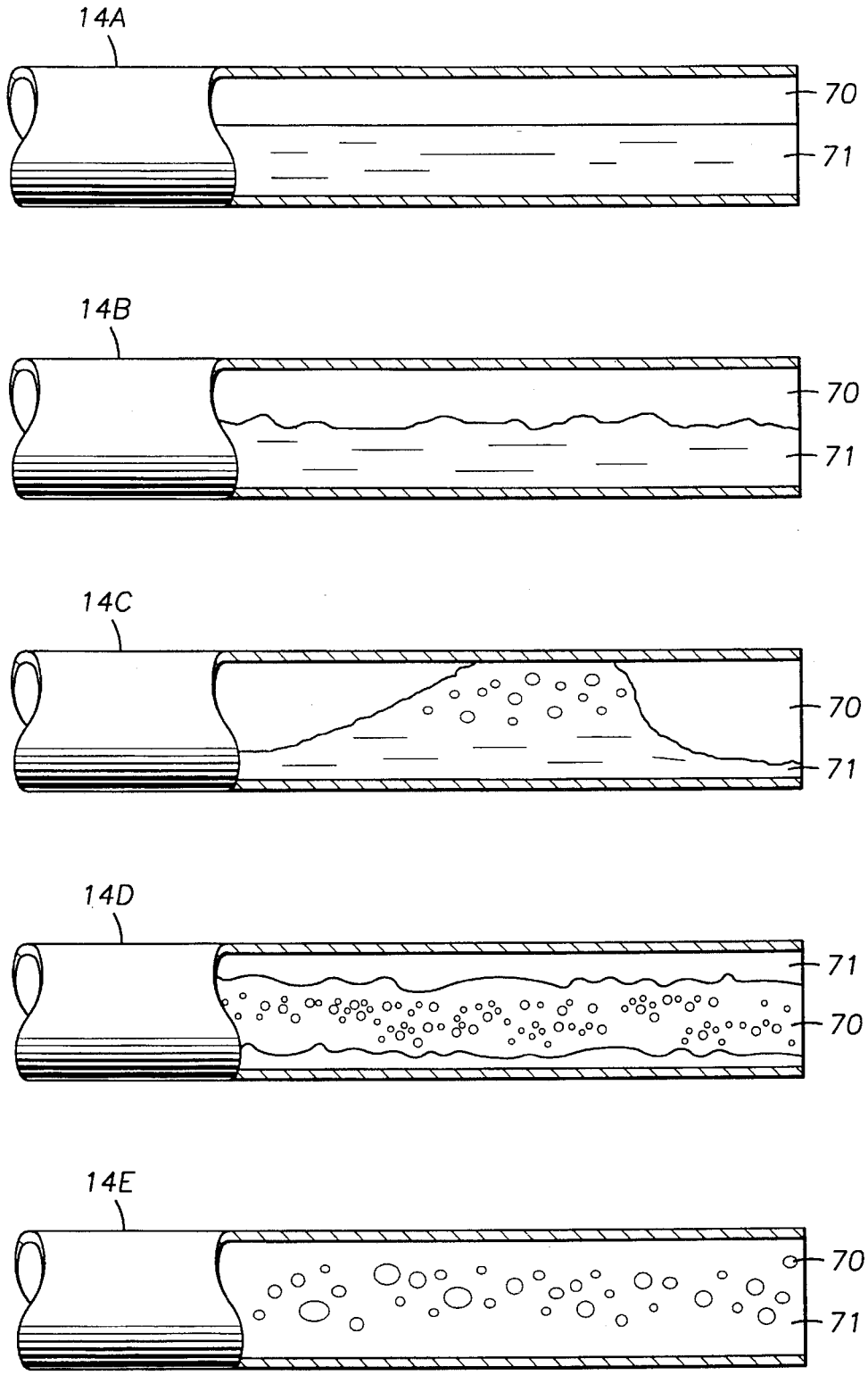
FIG. 3 shows various flow regimes which can exist in a horizontal wellbore.
Figure 4:
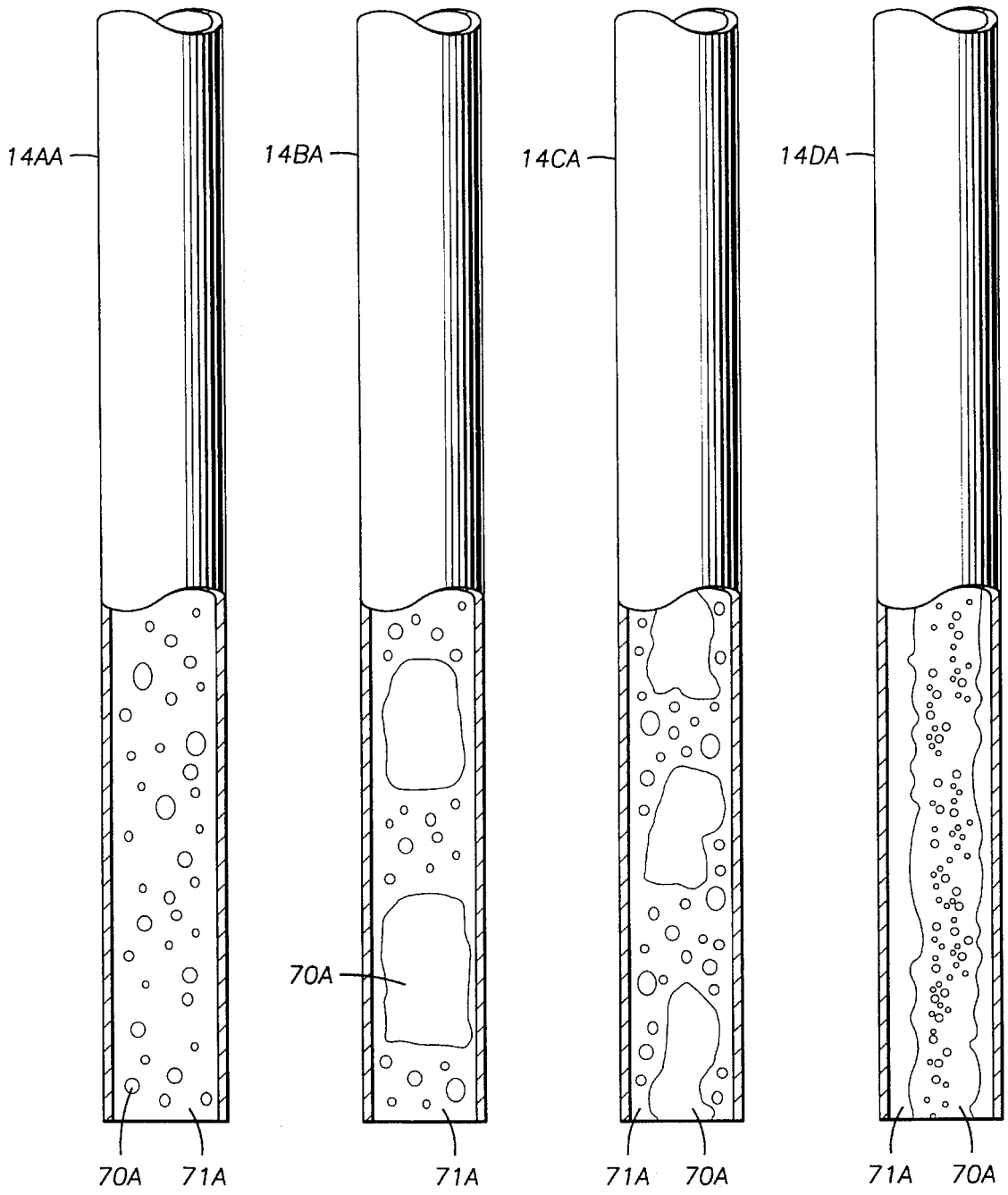
FIG. 4 shows various flow regimes which can exist in a vertical wellbore.

The flow regime in the wellbore (shown as 12 in FIG. 1) can be better understood by referring to FIGS. 3 and 4. In FIG. 3, various flow regimes are shown for two-phase flow inside a wellbore 12 which is substantially horizontal. In each of the five different flow regimes shown in FIG. 3, a more dense phase is shown as 71, and a less dense phase is shown as 70, the less dense phase 70 being substantially immiscible in the more dense phase 71. The less dense phase 70, for example, can be either gas or oil, and the more dense phase 71 can be either oil or water depending on the composition of the less dense phase 70 (oil, of course cannot simultaneously be the less dense phase 70 and the more dense phase 71). As is understood by those skilled in the art, the actual flow regime which exists within any wellbore 12 depends on, among other things, the fractional volume of each phase 70, 71, and the velocity of each phase 70, 71 flowing within the casing (shown in FIG. 3 as 14A through 14–E, respectively, for each of the five flow regimes shown in FIG. 3).

Corresponding flow regimes occurring within substantially vertical wellbores can be observed by referring to FIG. 4. The more dense phase is shown as 71A, and the less dense phase is shown as 70A in each of the flow regimes shown in FIG. 4. One notable difference in the flow regimes between those shown in FIG. 3 and those shown in FIG. 4, is that in the flow regimes typically associated with lower fluid velocities, for example the so-called "stratified smooth flow" as shown in FIG. 3, the phases can segregate by gravity across the diameter of the casing 14A in highly inclined wellbores. As is understood by those skilled in the art, it may be necessary to make measurements at a plurality of positions across the diameter of the casing 14 in order to be able to determine the flow regime, particularly in a wellbore which is highly inclined from vertical and has fluid phases which are segregated by gravity.

Figure 5:
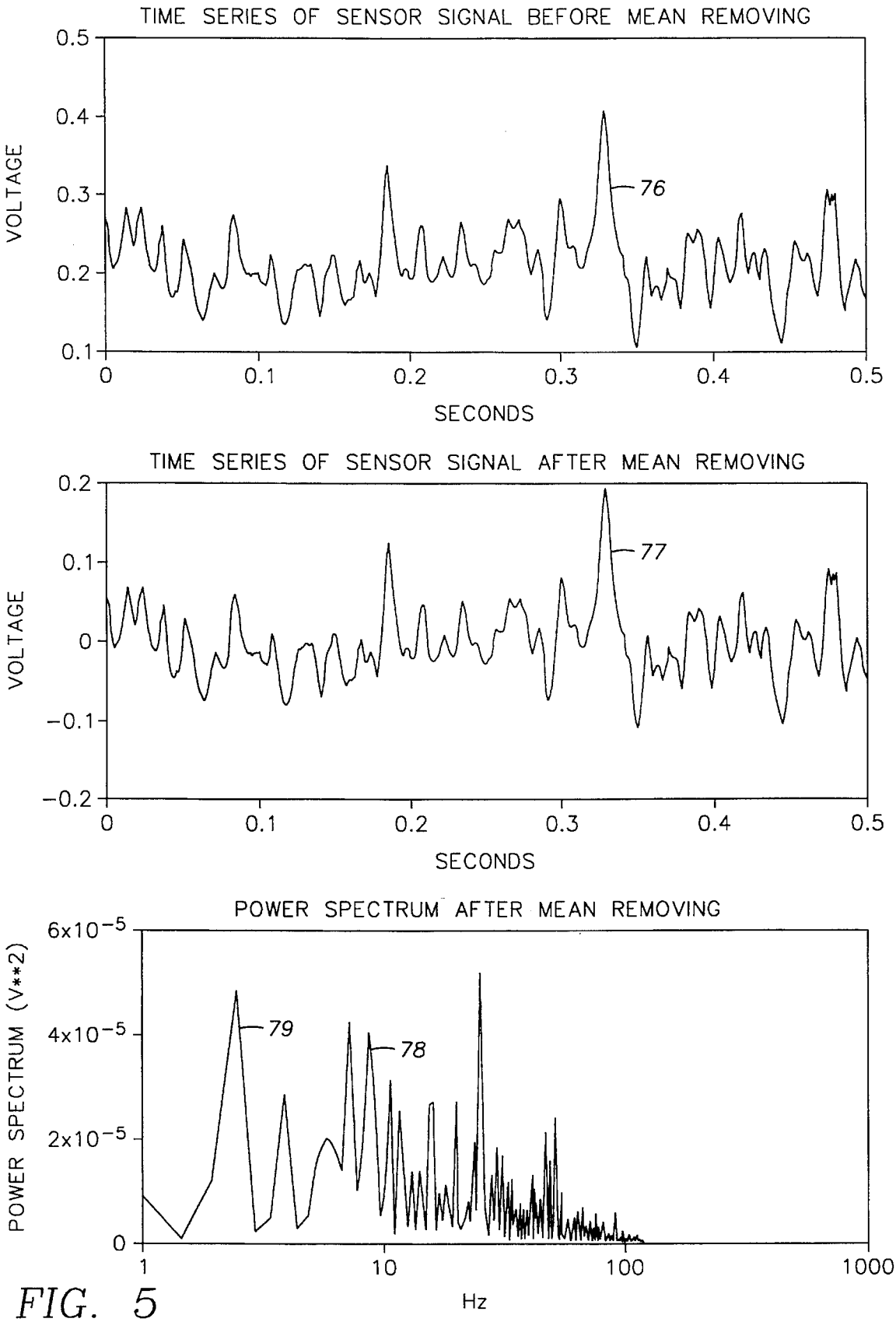
FIG. 5 shows a method of processing sensor data according to the present invention.

The preferred embodiment of the process of determining the flow regime from the sensor measurements can be better understood by referring to FIG. 5. For example, the measurements from the capacitance probe (shown in FIG. 2 as 52) can be represented as a graph at (a). Graph (a) is shown as a continuous curve at 76, but more typically the measurements represented by curve 76 will be composed of discrete measurement values each corresponding to a unique value of time, as indicated on the coordinate axis of graph (a), because the measurements are typically digitized either in the tool 10 or in the surface electronics 30. A series of digitized measurements made for a predetermined period of time is referred to hereinafter as a time series. It is to be explicitly understood that the process of generating a time series by digitizing the measurements made by the sensor is a matter of convenience in the transmission of signal data using the production logging tool 10 known in the art, and should not be construed as a limitation on the method of the present invention to the use of digitized sensor measurements. The method of the present invention can also be performed using sensor measurement signals which are transmitted to the surface electronics (shown in FIG. 1 as 30) in analog form. The present invention requires only that the sensor measurements be made for a period of time long enough to have the measurements be responsive to the flow regime, as will be further explained.

The digitized measurements in the time series can then be averaged to determine the magnitude of a DC component, also known as "bias" or "offset", which may be present in the measurements. The DC component typically provides information about the bulk composition of the fluids as measured by the sensor, and can therefore provide an indication of the physical distribution of fluids within the wellbore (shown as 12 in FIG. 1). The use of the DC component will be further explained. The step of determining the DC component value is performed in order next to remove the DC component from each one of the time-based measurements in the time series. After removal of the DC component value from the raw measurement values the time series can be represented as shown in graph (b) as curve 77.

The DC-adjusted time series in graph (b) is then processed by a spectral analysis program, such as a fast Fourier transform ("FFT") program, to determine the relative magnitudes of different component frequencies within the time series, as shown in graph (c) as a frequency spectrum curve 78. The spectral characteristics of the graph, such as presence of particular so-called "spectral peaks" or localized maxima at characteristic frequencies as shown generally at 79, and the apparent frequency width of the spectral peaks 79, are indicative of the flow regime. It is to be understood that the function performed by the FFT program on the time series can be performed by other programs known to those skilled in the art for determining frequency components contained in a signal, for example counting the number of "zero crossings", which are number of times the signal value passes through zero within a predetermined time period.

Each different flow regime, such as those shown in FIGS. 3 and 4, can have different spectral characteristics. The spectral characteristics for each flow regime can also be related to the type of sensor used to generate the time series of measurements. Spectral characteristics for each type of flow regime, and for each type of sensor can be determined, for example, by making measurements with the sensors disposed in a laboratory system known in the art as a "flow loop". The flow loop provides a conduit into which are injected known volumetric flow rates of various fluids of known composition and phase. In the flow loop, the known volumetric flow rates and known fluid compositions provide accurate knowledge of the actual flow regime. Therefore spectral analysis of sensor measurements made in the flow loop will represent spectra of known flow regimes.

Figure 6:
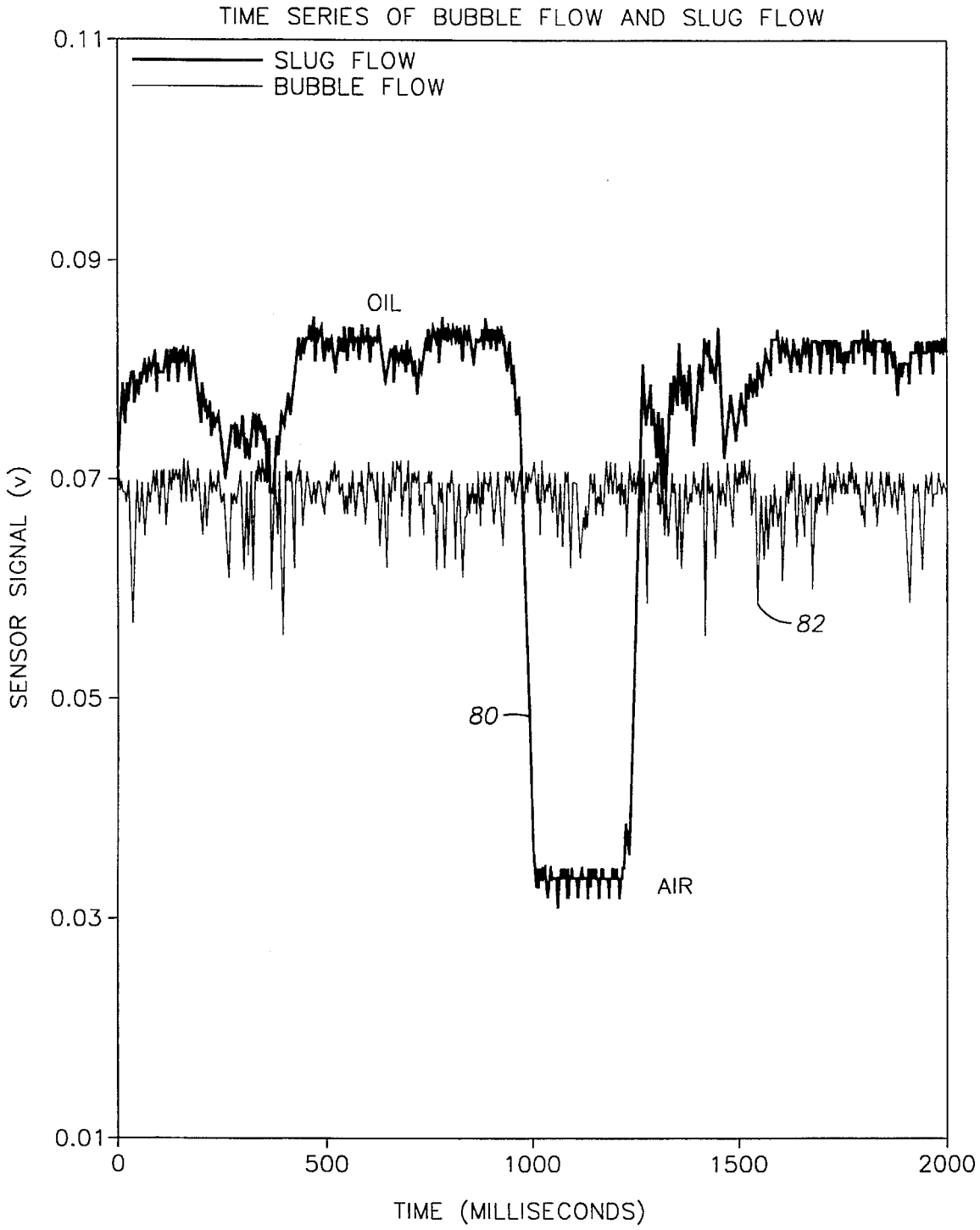
FIG. 6 shows time series data for bubble flow and slug flow.
Figure 7:
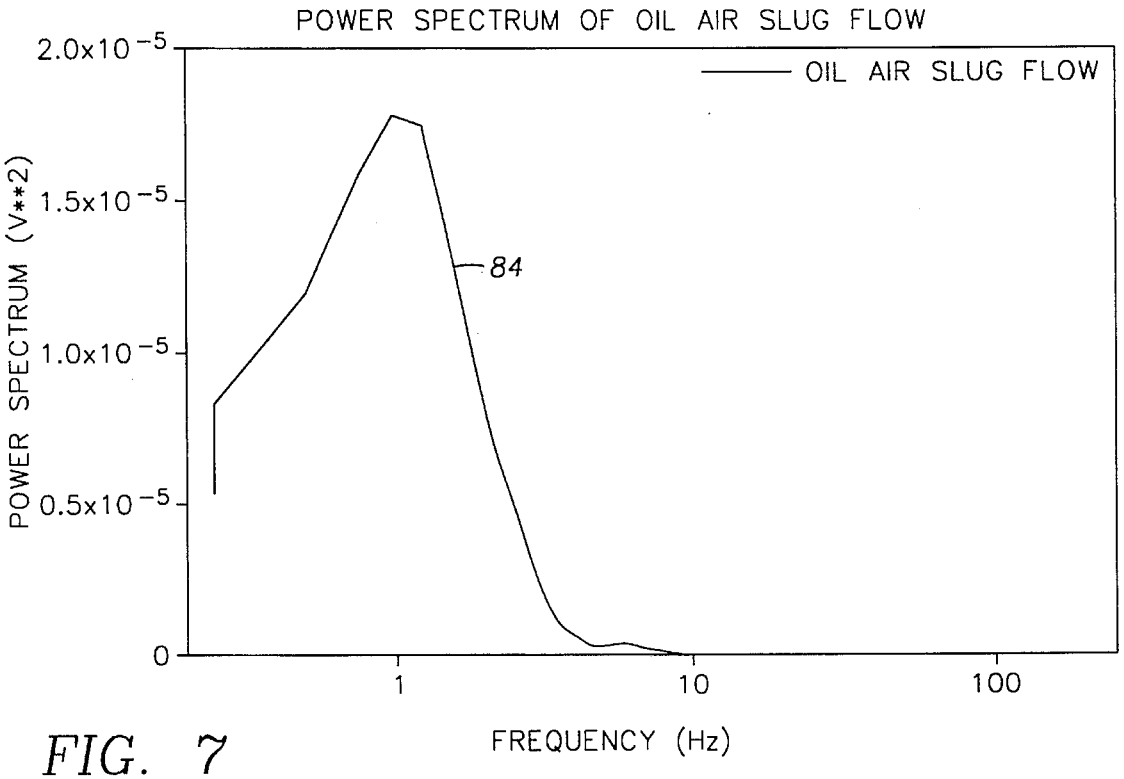
FIG. 7 shows a power spectrum of the slug flow measurements shown in FIG. 6.
Figure 8:
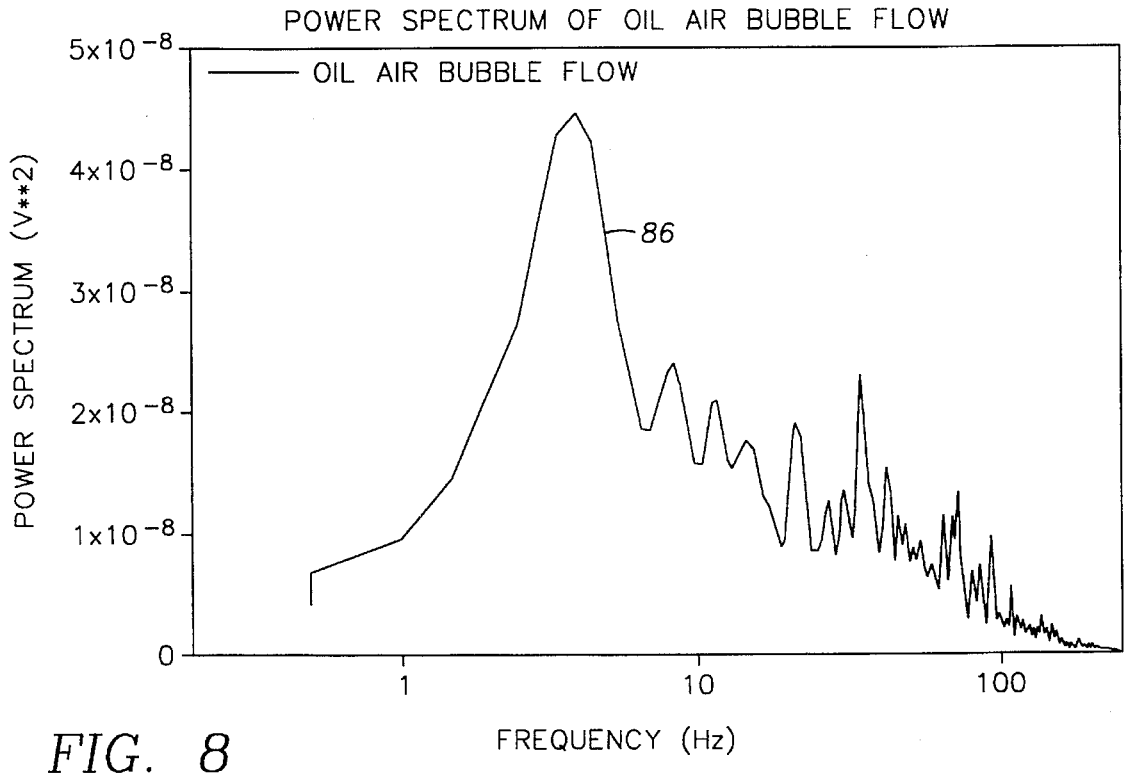
FIG. 8 shows a power spectrum of the bubble flow measurements shown in FIG. 6.

Time series sensor measurements for bubble flow and slug flow, for example, can be observed by referring to FIG. 6. Curve 80 in FIG. 6 represents measurements taken in the flow loop for the capacitance probe (shown in FIG. 2 as 52) when the probe 52 is positioned within slug flow consisting of oil and air (the air used as a substitute for natural gas). Curve 82 represents sensor measurements taken in the flow loop with the sensor positioned within bubble flow of air through oil. A power spectrum for the slug flow curve 80 can be observed in FIG. 7 as curve 84. A power spectrum for the bubble flow curve (82 in FIG. 6) can be observed in FIG. 8 as curve 86. It is apparent when observing the curves in FIGS. 7 and 8 that the spectrum for slug flow (84 in FIG. 7)

has a different peak frequency and bandwidth than does the, spectrum for bubble flow (86 in FIG. 8).

The previously described DC component, which for example in the bubble flow curve (82 in FIG. 6) is about 0.07 volts output of the sensor, can indicate that the fluid moving past the sensor consists of a mixture of about 20 percent air and 80 percent oil by volume, as determined by linear scaling of the DC value between the oil reading of about 0.08 volts and the air reading of about 0.03 volts as determined in the slug flow curve (80 in FIG. 6). Methods of determining the bulk composition of the fluid from the DC component of the signal are directly related to methods known in the art for determining fluid composition from depth-based sensor measurements.

While the present embodiment of the invention is directed to the use of measurements from the capacitance probe, a number of different types of sensors can be used to practice the method of the present invention, for example acoustic velocity sensors. It is to be understood that the sensor should have sufficiently rapid response time and have fine enough spatial resolution in order to have sufficient frequency response range, or bandwidth, to determine all of the significant frequency components of the flow regime under investigation. Typically a bandwidth of 500 Hz can be sufficient to determine most of the flow regimes likely to be encountered in producing wellbores.

Comparison of the frequency spectrum curve (shown in FIG. 5 as 78) with frequency spectrum curves for known flow regimes can be performed by a number of different methods including visual comparison by the system operator, and correlation by a computer program resident in the surface electronics (shown in FIG. 1 as 30).

After the flow regime has been determined by comparison of the spectrum curve (78 in FIG. 5) to those of known flow regimes, it is possible to calculate volumes of fluids entering the wellbore (12 in FIG. 1) from the first and second zones (20 and 22, respectively in FIG. 1) using methods of calculation known in the art corresponding to the flow regime thus determined.

DESCRIPTION OF ALTERNATIVE EMBODIMENTS

The method of the previously described embodiment of the present invention, in which the time series signal from the sensor is characterized as to its frequency components, uses a form of signal characterization referred to as frequency component analysis. Alternatively, it is possible to determine the flow regime by characterizing the time series sensor measurements using methods which are generally referred to as correlations.

Figure 9:
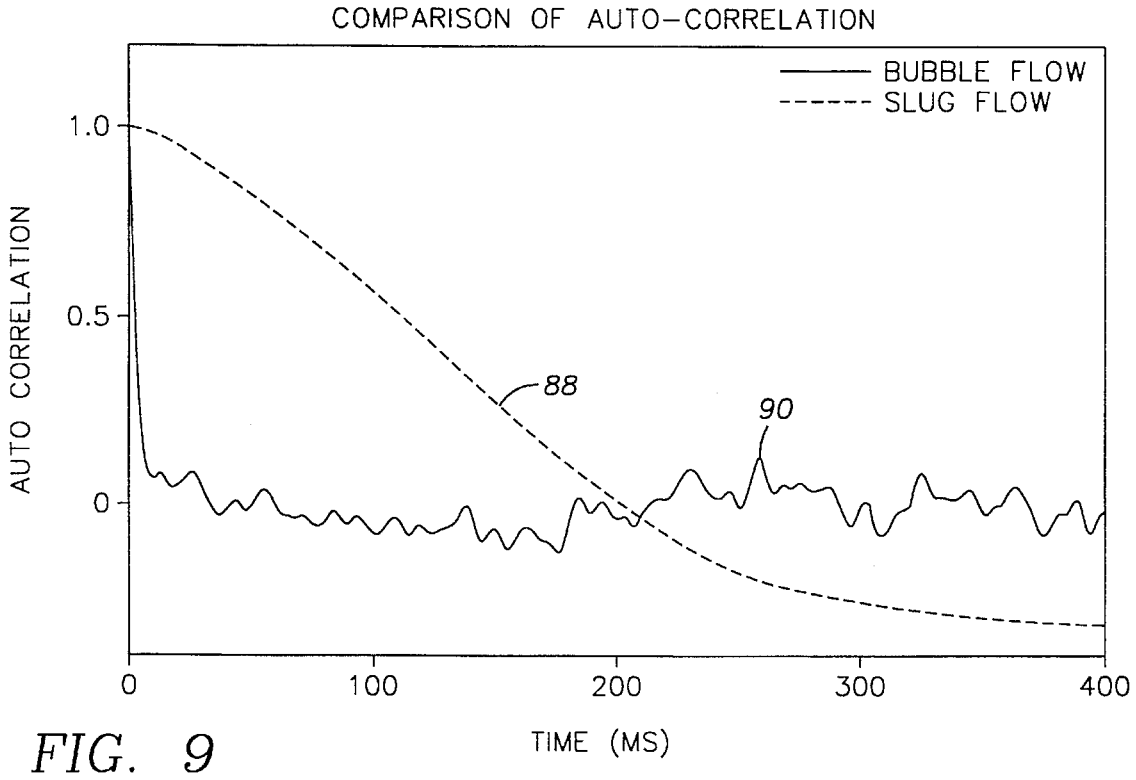
FIG. 9 shows auto correlation functions of the measurements shown in FIG. 6.

For example, FIG. 9 shows an auto correlation function for the sensor measurements made with the sensor positioned in slug flow as curve 88, the corresponding time series being shown as curve 80 in FIG. 6. Curve 88 is generated by calculating a degree of correspondence of the time series measurements of curve 80 compared with themselves at an amount of time difference as indicated on the coordinate axis of the graph of FIG. 9. The time at which the correspondence drops to near zero is indicative of a so-called "cut-off" frequency, above which only a very small portion, generally 10 percent or less, of the total energy in the measurements is contained.

A similarly generated auto-correlation function can be observed for bubble flow as curve 90, corresponding to the time series shown in FIG. 6 as curve 82.

Figure 10:
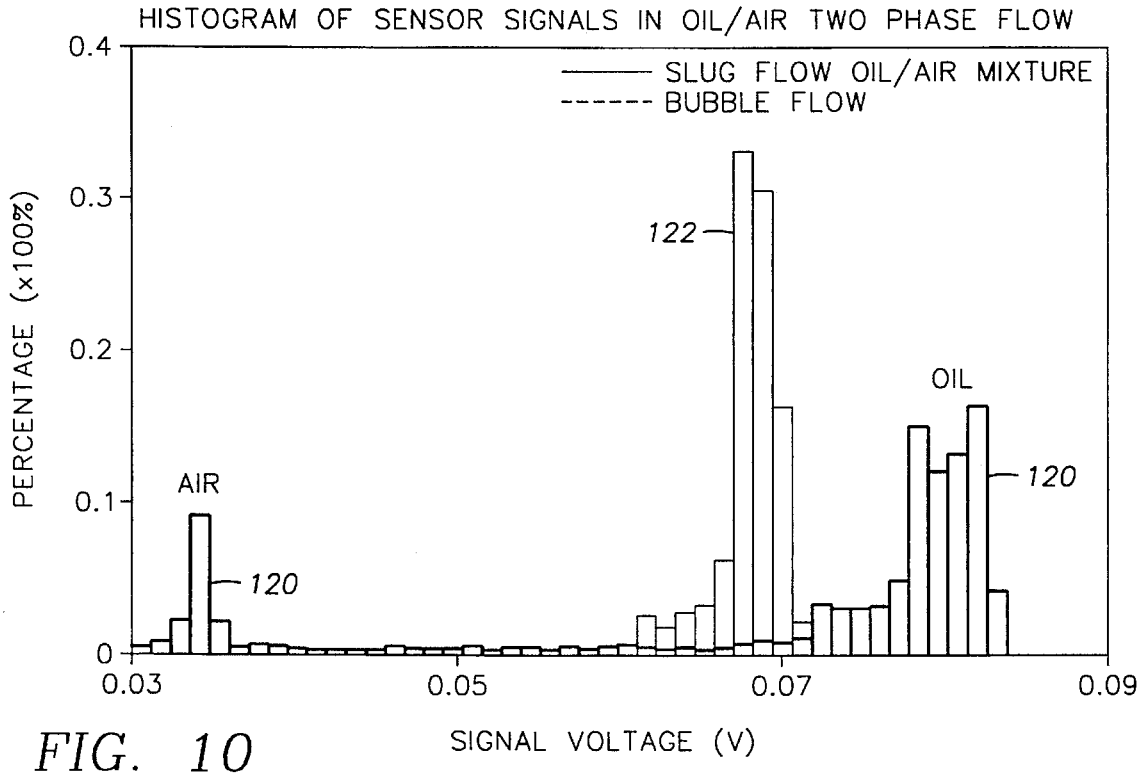
FIG. 10 shows histograms of the measurements shown in FIG. 6.

Another alternative method of characterizing the time series measurements can be broadly classified as an analysis of the variability of the time series, an example of which is shown in FIG. 10. FIG. 10 is a graphic representation of the number of occurrences (shown in the ordinate axis as percentage of the total number of signal samples) of each sensor output value. The representation in FIG. 10 takes the form of histograms, a first histogram shown generally at 120 corresponding to the time series (shown in FIG. 6 as curve 80) for slug flow; and a second histogram shown generally at 122 corresponding to the time series for bubble flow (shown in FIG. 6 as curve 82). The first histogram 120 exhibits a bimodal distribution, which is consistent with the sensor alternately being immersed in one of the two phases of the slug flow. Histograms such as those shown in FIG. 10 at 120 and 122 can be developed for the various types of sensors corresponding to different flow regimes by laboratory testing or numerical simulation. The actual presentation of the number of occurrences need not be restricted to a histogram but can alternatively be made in forms such as a continuous curve (not shown) on a graph having sensor reading and number of occurrences as coordinates, similar to the graph of FIG. 10. Presentation and analysis of the number of sensor value occurrences with respect to sensor value can be broadly categorized as "occurrence distribution".

Figure 11A:
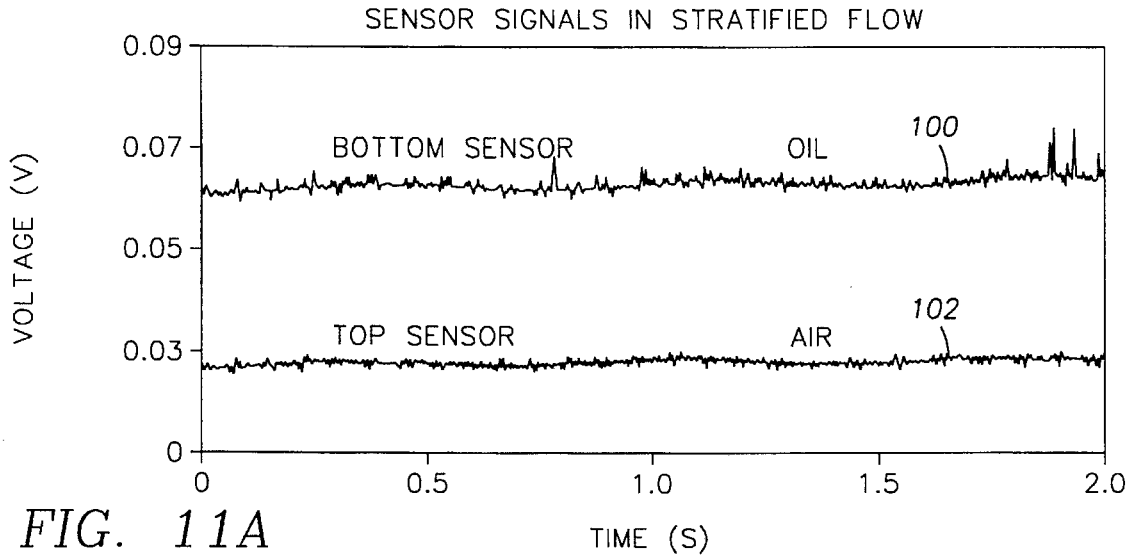
FIG. 11A shows sensor measurements at the top and at the bottom of a horizontal conduit having stratified flow.
Figure 11B:
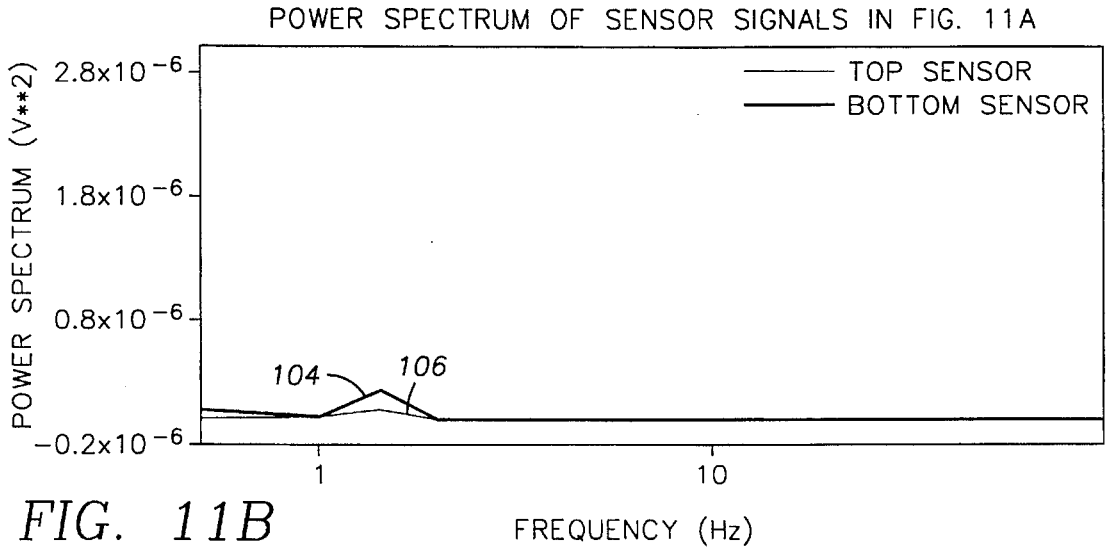
FIG. 11B shows power spectra for the sensor measurements of FIG. 11A.
Figure 11C:
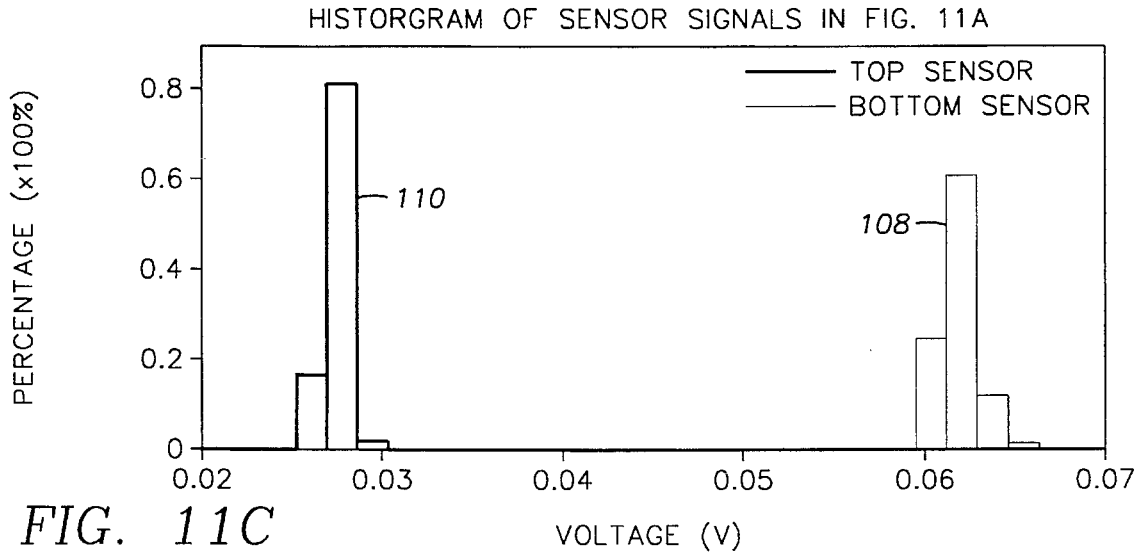
FIG. 11C shows histograms for the sensor measurements of FIG. 11A.

As previously explained herein, certain flow regimes occurring in highly inclined wells, such as slug flow and stratified flow (shown in FIG. 3 as 14C and 14A, respectively) may be better characterized by using a plurality of sensors positioned at different positions within the cross-sectional area of the conduit. For example, in FIG. 11A, time series sensor measurements, made in the flow loop, are shown for capacitance probes (such as that shown as 52 in FIG. 2) positioned near the top, shown as curve 102, and near the bottom, shown as curve 100 of a substantially horizontal conduit having stratified oil/air flow within. FIG. 11B shows power spectra, as generated by the first embodiment of the invention, for the top sensor at 106 and for the bottom sensor at 104. The spectra in FIG. 11B are consistent with stratified flow since both sensors are nearly devoid of any high power frequency components. FIG. 11C shows histograms of the sensor measurements shown in FIG. 11A calculated according to the third embodiment of the invention. Histogram 108 in FIG. 11C represents the measurements from the bottom sensor and histogram 110 represents the measurements from the top sensor.

Figure 12A:
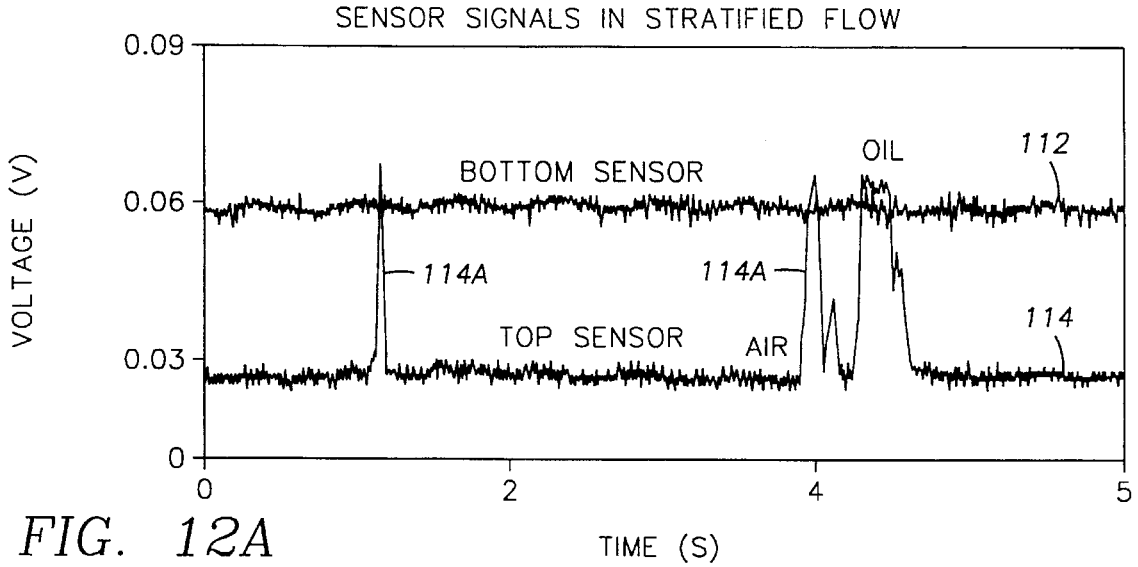
FIG. 12A shows sensor measurements at the top and at the bottom of a horizontal conduit having slug flow.
Figure 12B:
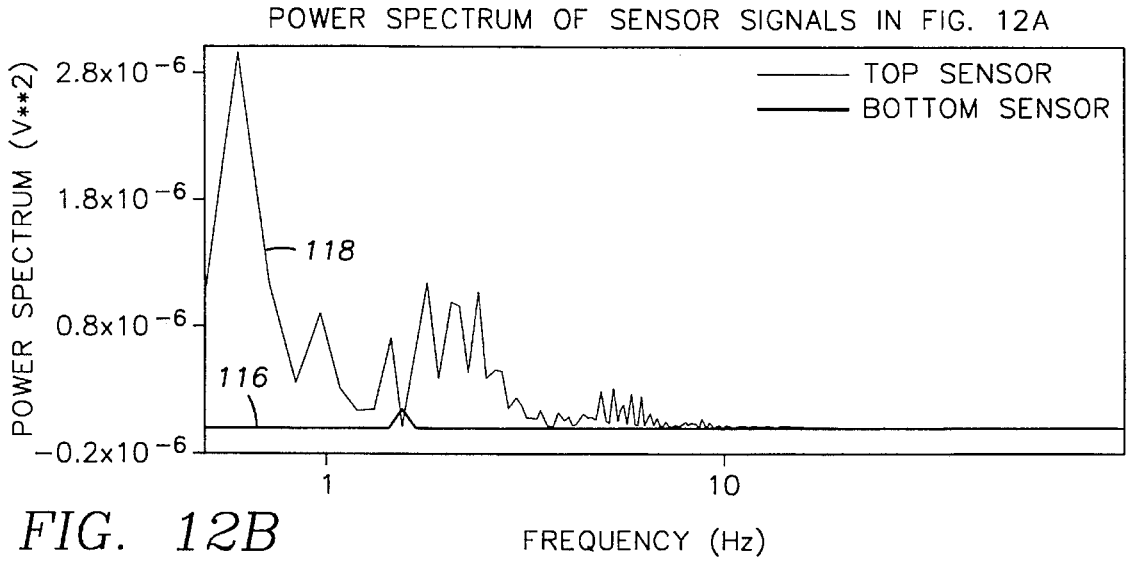
FIG. 12B shows power spectra for the sensor measurements of FIG. 11A.
Figure 12C:
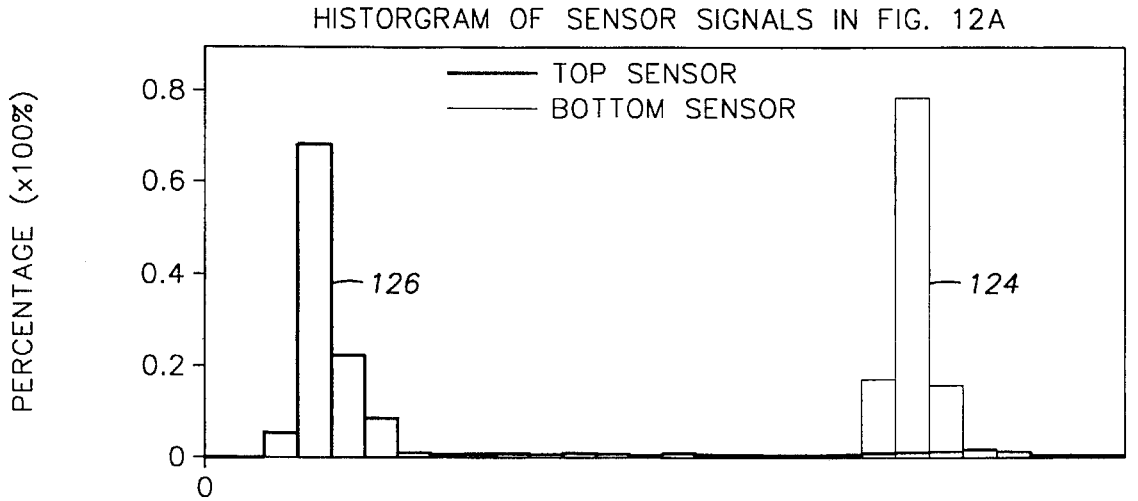
FIG. 12C shows histograms for the sensor measurements of FIG. 11A.

FIG. 12A represents sensor measurements taken in the flow loop capacitance probes positioned near the top, as shown at curve 114, and near the bottom, as shown at 112 of a conduit having slug flow. The measurements from the top sensor, shown at 114, exhibit response which is typical of slug flow, as particularly indicated by changes in the sensor output from indicating being substantially immersed in the less dense phase (air) to indicating substantial immersion in the more dense phase (oil), as shown generally at 114A. The bottom sensor measurements, shown generally at 112, do not exhibit significant variation from indicating immersion in the more dense phase (oil). FIG. 12B represents power spectra calculated according to the first embodiment of the invention for the sensor measurements of FIG. 12A for the top sensor as shown generally at 118, and for the bottom sensor as shown generally at 116. Histograms calculated according to the third embodiment of the invention for the sensor measurements shown in FIG. 12A are shown in FIG. 12C for the top sensor at 126 and for the bottom sensor at 124.

The different embodiments of the present invention disclosed herein, including the various methods of characterizing the time series measurements for comparison with similarly characterized measurements of known flow regimes, are meant to be exemplary and not limiting the present invention only to using the forms of signal characterization disclosed herein. The present invention should be limited in scope only by the claims appended hereto.

What is claimed is:

1. A method of determining a flow regime of fluids flowing through a conduit, said fluids having more than one phase, said method comprising the steps of:

positioning a sensor in said conduit, said sensor in contact with and generating measurements of said fluids, said measurements responsive to a fluid phase composition in said conduit;

generating measurements from said sensor for a period of time;

characterizing said measurements with respect to changes in magnitude of said measurements during said period of time by performing a variability analysis of said measurements; and comparing said characterized measurements from said sensor in said conduit to similarly characterized measurements of a similar sensor positioned within flow streams having known flow regimes.

2. The method as defined in claim 1 wherein said sensor comprises a temperature sensor.

3. The method as defined in claim 1 wherein said sensor comprises a capacitance probe.

4. The method as defined in claim 1 wherein said sensor comprises a pressure sensor.

5. The method as defined in claim 1 wherein said step of characterizing said measurements further comprises determining frequency components of said measurements.

6. The method as defined in claim 5 wherein said step of determining frequency components comprises generating a Fourier transform of said measurements.

7. The method as defined in claim 1 wherein said step of characterizing said measurements further comprises generating an auto-correlation function of said measurements.

8. The method as defined in claim 1 wherein said step of performing said variability analysis comprises determining an occurrence distribution of said measurements.

9. The method as defined in claim 1 further comprising positioning a plurality of sensors at different positions within the cross-sectional area of said conduit, each of said plurality of sensors capable of discriminating more than one phase in said fluids.

10. A method of determining a flow regime of fluids flowing through a wellbore penetrating an earth formation, said fluids having more than one phase, said method comprising the steps of:

positioning a production logging tool in said wellbore, said production logging tool including at least one sensor in contact with said fluids, said at least one sensor for generating measurements of said fluids, said measurements corresponding to a fluid phase composition in said conduit;

generating measurements from said sensor for a period of time;

characterizing said measurements with respect to changes in magnitude of said measurements during said period of time by performing a variability analysis of said measurements; and comparing said characterized measurements to similarly characterized measurements of a similar sensor positioned within flow streams having known flow regimes.

11. The method as defined in claim 10 wherein said sensor comprises a fluid pressure sensor.

12. The method as defined in claim 10 wherein said sensor comprises a capacitance probe.

13. The method as defined in claim 10, wherein said sensor comprises a pressure sensor.

14. The method as defined in claim 10 wherein said step of characterizing said measurements further comprises generating a Fourier transform of said measurements.

15. The method as defined in claim 10 wherein said step of characterizing said measurements further comprises generating an auto correlation function of said measurements.

16. The method as defined in claim 10 wherein said step of performing said variability analysis comprises generating an occurrence distribution of said measurements.

17. The method as defined in claim 10 further comprising positioning a plurality of sensors at different positions within the cross-sectional area of said wellbore, each of said sensors capable of discriminating more than one phase in said fluids.

18. A method of determining volumes of each of a plurality of fluids entering a wellbore penetrating an earth formation comprising the steps of:

inserting a production logging tool into said wellbore, said tool comprising a fluid density device, a water holdup sensor and a fluid velocity sensor;

generating measurements with respect to depth from said fluid density device, said water holdup sensor and said fluid velocity sensor;

positioning said tool at a predetermined location within said wellbore;

recording output of at least said water holdup sensor for a period of time;

characterizing said output with respect to changes in magnitude of said output during said period of time by performing a variability analysis of said output;

determining a flow regime at said predetermined location by comparing said characterized output to similarly characterized output of said water holdup sensor positioned within flow streams having known flow regimes; and calculating said volumes of each of said fluids entering said wellbore from said measurements by using a flow calculation model corresponding to said flow regime previously thus determined.

19. The method as defined in claim 18 further comprising repeating said steps of positioning said tool through calculating said volumes at a plurality of predetermined locations within said wellbore.

20. The method as defined in claim 18 wherein said step of characterizing said output further comprises generating a Fourier transform of said time series.

21. The method as defined in claim 18 wherein said step of characterizing said output further comprises generating an auto-correlation function of said time series.

22. The method as defined in claim 18 wherein said step of performing said variability analysis comprises determining an occurrence distribution of said output.

23. The method as defined in claim 18 further comprising positioning a plurality of sensors at different positions within the cross-sectional area of said wellbore, each of said sensors capable of discriminating more than one phase in said fluid.

* * * * *